US006499824B1

(12) United States Patent
Nitta

(10) Patent No.: US 6,499,824 B1
(45) Date of Patent: Dec. 31, 2002

(54) INK JET RECORDING APPARATUS WITH DEDICATED WIPING MEMBERS

(75) Inventor: Tetsuhiro Nitta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/664,784

(22) Filed: Sep. 19, 2000

Related U.S. Application Data

(62) Division of application No. 08/982,776, filed on Dec. 2, 1997, now Pat. No. 6,196,659.

(30) Foreign Application Priority Data

Dec. 4, 1996 (JP) ..... 8-232870

(51) Int. Cl.[7] ..... B41J 2/165
(52) U.S. Cl. ..... 347/33; 347/21
(58) Field of Search ..... 347/33, 43, 20, 347/22, 29, 30, 32, 40, 21, 101

(56) References Cited

U.S. PATENT DOCUMENTS

| | | | | |
|---|---|---|---|---|
| 5,182,582 A | | 1/1993 | Okamura | 347/33 |
| 5,548,310 A | | 8/1996 | Binnert et al. | 347/33 |
| 5,549,740 A | | 8/1996 | Takahashi et al. | 106/20 R |
| 5,585,826 A | | 12/1996 | Schroeder et al. | 347/32 |
| 5,614,930 A | | 3/1997 | Osborne et al. | 347/33 |
| 5,731,825 A | | 3/1998 | Danzuka et al. | 347/43 |
| 5,786,830 A | | 7/1998 | Su et al. | 347/33 |
| 5,898,443 A | | 4/1999 | Yoshino et al. | 347/101 |
| 5,997,128 A | * | 12/1999 | Lou et al. | 347/33 |
| 6,155,666 A | * | 12/2000 | Sugimoto et al. | 347/24 |

FOREIGN PATENT DOCUMENTS

| | | |
|---|---|---|
| EP | 0 581 135 | 2/1994 |
| EP | 0 604 068 | 6/1994 |
| EP | 0 606 022 | 7/1994 |
| EP | 0 699 535 | 3/1996 |
| EP | 0 726 155 | 8/1996 |
| JP | 53-24486 | 3/1978 |
| JP | 54-43733 | 4/1979 |
| JP | 55-150396 | 11/1980 |
| JP | 58-128862 | 8/1983 |
| JP | 8-281968 | 10/1996 |

* cited by examiner

*Primary Examiner*—John S. Hilten
*Assistant Examiner*—Shih-wen Hsieh
(74) *Attorney, Agent, or Firm*—Fitzpatrick, Cella, Harper & Scinto

(57) ABSTRACT

An ink jet recording apparatus with a carriage having a first liquid discharge unit with first liquid discharge openings and a second liquid discharge unit with second liquid discharge openings, the first liquid discharge unit and the second liquid discharge unit arranged for performing discharge when the carriage is moving, a first wiping member for wiping the first liquid discharge unit surface when the carriage is stopped at a first stopping position, and a second wiping member for wiping the second liquid discharge unit surface when the carriage is stopped at a second stopping position which is different from the first stopping position, wherein wiping by the first wiping member and the second wiping member is performed by movement of the respective wiping member along a direction different from the carriage movement direction.

11 Claims, 8 Drawing Sheets

INK JET RECORDING APPARATUS WITH DEDICATED WIPING MEMBERS

This application is a division of U.S. application Ser. No. 08/982,776, filed Dec. 7, 1997, now U.S. Pat. No. 6,196,659, issued Mar. 6, 2001, and claims priority under 35 U.S.C. § 119 to JP 323870, filed Dec. 4, 1996.

BACKGROUND OF THE INVENTION

"This application is a division of U.S. Application No. 08/982,776, filed Dec. 7, 1997, now U.S. Pat. No. 6,196,659, issued Mar. 6, 2001, and claims priority under 35 U.S.C. §119 to JP 323870, filed Dec. 4, 1996."

1. Field of the Invention

The present invention relates to an ink jet recording apparatus capable of obtaining high quality images on a recording medium. More particularly, the invention relates to an ink jet recording apparatus that records by discharging recording ink and processing liquid such as an image enhancement agent that insolubilizes or coagulate coloring material in ink.

The present invention is applicable to all the equipment and devices that uses a recording medium formed by paper, cloth, leather, unwoven textile or the like, or a recording medium formed even by metallic material. As specific equipment and devices to which the present invention is applicable, there is a printer, a copying machine, a facsimile equipment, or some other office equipment or those usable as industrial production equipment.

2. Related Background Art

Conventionally, an ink jet recording method has been utilized for a printer, a copying machine, or the like, because this method enables operates at lower running costs with a lesser amount of noises, while making it easier to produce apparatuses compactly, and also, to facilitate color handling.

However, if it is intended to obtain images on a recording medium, which is the so-called ordinary paper, by means of those recording apparatuses that utilize the ink jet recording method, the waterproof capability of images thus recorded becomes insufficient or when it is intended to form color images, compatibility is not obtainable in forming highly densified images having no feathering and those having no running created between colors. As a result, it is impossible to obtain color images having good image fastness, and excellent quality as well.

In recent years, it has been made practicable to use the ink that contains waterproof coloring material in it as a method for enhancing the waterproof capability of recorded images. However, not only such waterproof capability is far from sufficient, but also, in principle, an ink of the kind is hardly soluble to water once it has been dried, which may often result in the nozzle clogging of a recording head. Therefore, there is apparently a disadvantage that the structure of the apparatus should become more complicated in order to prevent such nozzle clogging.

Also, a number of techniques have been disclosed conventionally for the enhancement of the fastness of recorded objects. In the specification of Japanese Patent Laid-Open Application No. 53-24486, a technique is disclosed, in which colors are laked and fixed by giving post-process to a colored object in order to promote wet fastness thereof.

In the specification of Japanese Patent Laid-Open Application No. 54-43733, a recording method is disclosed, in which the two or more components that promote the film formation capability when being in contact with each other at the room temperature or being heated by use of the ink jet recording method, thus making it possible to obtain a printed object whose film has been made strongly adhesive to the object when each of the components are in contact on a recording medium.

In the specification of Japanese Patent Laid-Open Application No. 55-150396, there is disclosed a method for providing water soluble color ink with the waterproofing agent for the formation of colors and lake after an ink jet recording has been executed.

In the specification of Japanese Patent Laid-Open Application No. 58-128862, an ink jet method is disclosed in which the position of an image to be recorded is discriminated beforehand, and then, recording ink and processing ink are overlaid for recording. A method is also disclosed in which a drawing is made in processing ink before recording ink is applied; processing ink is overlaid on a drawing written in recording ink beforehand; or recording ink is overlaid on a drawing written in processing ink beforehand, and processing ink is again overlaid to complete the drawing.

However, in these publications, no disclosure is made as to the recovery means, head structure, and tank structure, which are all characteristics of an ink jet recording apparatus for the maintenance of reliability of discharges, and also, as to the recording mode or the like which is needed for the enhancement of quality of recorded images.

On the other hand, there are fundamentally the problems inherent in the ink jet recording method as given below.

Firstly, ink adheres to the discharge opening surface of a recording head due to fine ink droplets (mist) generated other than the discharged main ink droplets when ink droplets are discharged from a recording head to a recording medium, such as a paper sheet, an OHP film, for recording, and ink droplets rebounded from the recording medium. If such ink is concentrated adhesively on the circumference of each discharge opening in a large quantity, or if paper particles or other foreign substances adhere to such concentration of ink, discharges are blocked, resulting in malfunction such as ink being discharged in the unexpected directions (twisting) or discharges of ink droplets being disabled (non-discharges).

Secondly, if ink in the nozzles of a recording head is evaporated and dried when printing is at rest, that is, if no discharges are made for a long time, to be exact, then overly viscous and fixed ink tends to clog the interior of nozzles to cause the twisted discharges or other defective discharges.

Therefore, in order to eliminate these unfavorable events, recovery means is provided for the ink jet recording method.

As means for cleaning and removing unwanted ink, paper particles and other foreign substances adhering to the discharge opening surface, which are caused by mist and rebounding ink droplets from a recording medium as described above as the first problem, it is generally adopted to arrange a structure in which the discharge opening surface is wiped off (wiping) by use of a blade formed by rubber or some other elastic material.

As means for solving the second problem described above, it is generally adopted to arrange the structure so that a recording head is capped to prevent ink from becoming overly viscous and fixed in the nozzle of the recording head at the time of non-recording, and that the ink, which becomes overly viscous and fixed to result in defective discharges and the adhesion of the foreign substances or the like and cannot be removed by means of the blade, is removed by exhausting the overly viscous ink from the nozzles by means of a suction pump connected with the cap for recovering the head for the performance of normal discharges. Further, for the operation of an on-demand type ink jet recording method, the plural discharge openings, which are arranged for one recording head, are not necessarily used at a time always. As a result, there are some nozzles that are not used for more than a certain period of time. Also, in a case where a plurality of recording heads are used such as for a color recording apparatus, there are some recording heads to which no data are transferred (the heads which are not currently engaged in recording), that is, the recording heads which are, not used. If a carriage is caused to scan or come to a stop while the discharge opening surface of the head mounted on it is not capped, ink is evaporated and dried on the discharge opening surface and in the interior thereof from which no ink has been discharged for a certain period continuously. As a result, the discharge capability is lowered to cause the degradation of recorded images eventually. In order to prevent such phenomenon as this, it is generally practiced for an ink jet recording apparatus to discharge ink in a specific location per certain periodical interval irrespective of recording data, thus causing ink in the nozzles to be exhausted to the outside to refresh ink. In this way, the discharge condition is always maintained normally and appropriately. Such ink discharge operation as this is called pre-discharge.

Ink by the pre-discharge described above is discharged to the location called pre-discharge position arranged separately in the cap of a recovery unit so that ink thus discharged is not caused to fly over a recording medium or in the interior of the recording apparatus to stain it.

For an ink jet recording apparatus that discharges ink and processing liquid, there is proposed a structure in the specification of Japanese Patent Laid-Open Application No. 8-281968 Japanese Patent Application No. 7-202635 in which caps, pumps, and wiping means are provided separately for use of ink discharge and for use of processing liquid discharge as a pre-discharge structure which is arranged for the solution of the problems described above.

Particularly, with regard to the wiping structure, it is proposed to provide a structure in which the wiping directions of ink and processing liquid are made different when wiping is performed in the main scanning direction of a carriage. However, this proposal is still insufficient from the viewpoint of the compatibility between a higher reliability such as no ink coagulation, fixation, or the like occurring in the recording apparatus and the simplification of the wiping mechanism.

Along the demands more on higher image quality, an ink jet recording apparatus has more numbers of nozzle arrays for discharging deep and light ink or the like. In this case, if a structure is still such as to wipe the nozzle arrays by the provision of the corresponding numbers of blades, it automatically leads to the increased costs inevitably.

SUMMARY OF THE INVENTION

It is one of the objects of the present invention to provide an ink jet recording apparatus capable of presenting excellent waterproof capability on an ordinary paper sheet in a better condition than the conventional art, and also, capable of presenting the compatibility between a highly reliable image recording that provides high quality having no feathering and running between colors at the time of color recording and a higher reliability with which it can prevent ink from being coagulated and fixed in the recording apparatus, hence preventing the head from being clogged.

It is another object of the invention to provide an ink jet recording apparatus capable of providing the compatibility between the higher reliability of preventing the coagulation and fixation of ink or the like in the recording apparatus and the simplification of the wiping mechanism therefor.

It is still another object of the invention to provide an ink jet recording apparatus comprising a carriage having a recording liquid discharge unit provided with recording liquid discharge openings for discharging recording liquid and a processing liquid discharge unit provided with processing liquid discharge openings for discharging processing liquid to process recording liquid arranged therefor to perform the movement thereof; wiping member for use of recording liquid dedicated to wiping the surface having the recording liquid discharge openings arranged therefor when the movement of the carriage is suspended; and wiping member for use of processing liquid dedicated to wiping the surface having the processing liquid discharge openings arranged therefor when the movement of the carriage is suspended. For this ink jet recording apparatus, the dedicated wiping by the wiping member for use of recording liquid and by the wiping member for use of processing liquid are executed, respectively, by changing the stopping position of the carriage.

In accordance with the preferred embodiments of the present invention, an ink jet recording apparatus is structured to discharge a recording medium beforehand a colorless or light colored liquid containing a chemical compound that insolubilizes coloring material in ink in accordance with image information, and then, to discharge monochrome color or multiple color ink in accordance with the image information. The apparatus thus structured is to perform wiping by moving wiping means for cleaning off the discharge opening surface of the ink jet recording head that discharges the processing liquid that insolubilizes coloring material in ink against solvent in the direction of the nozzle array of the ink jet head, and to make the stopping position of the carriage shiftable for wiping in accordance with the nozzle array of the ink jet head.

In accordance with the present invention, it is possible to materialize an ink jet recording apparatus for forming images by discharging ink and processing liquid to a recording medium, which is provided with a highly reliably recovery to produce good waterproof capability of images without running on the boundaries between different colors, but not to make coloring material in ink excessively insolubilized in the recording apparatus, with an arrangement that does not allow ink and processing liquid to be in contact with each other in the recovery system unit.

Particularly with respect to the wiping structure in which wiping is performed in the direction of increased nozzle arrays of an ink jet head, it is made possible to change the stopping positions of the carriage for the execution of wiping without increase the number of the blades, thus contributing to the reduction of costs significantly.

Also, the locus of the leading end of the wiping member is made parallel to the ink jet head when wiping is performed, thus facilitating the management and control of the amount of blade advancement and the contact angle and pressure to be exerted by the blade. Therefore, it becomes possible to enhance the performance of the blade.

Further, the wiping direction is made arbitrarily changeable in accordance with the nozzle array of an ink jet head. Also, the wiping member is provided with a first retracted position and a second retracted position where it does not abut upon the ink jet head so that the reciprocation of wiping becomes possible for the enhancement of wiping throughput accordingly.

DETAILED DESCRIPTION OF THE PREFERRED EMBODIMENTS

Hereinafter, with reference to the accompanying drawings, the specific description will be made of an ink jet recording apparatus in accordance with the present invention.

(Embodiment 1)

In FIG. 1 to FIG. 4, the ink jet recording apparatus of the present invention is shown.

Figure 1:
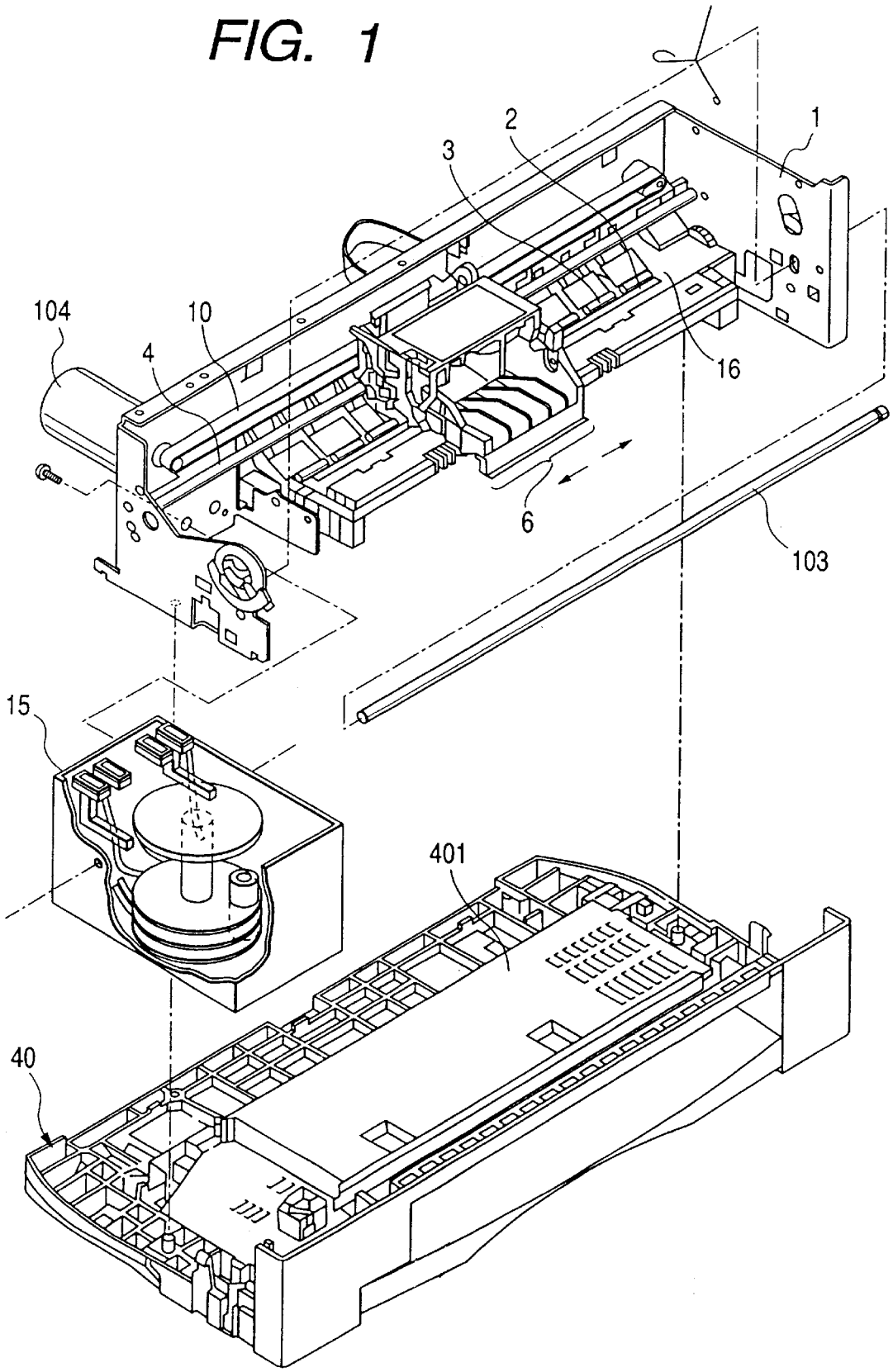
FIG. 1 is an exploded perspective view which shows the structure of the recording unit of an ink jet recording apparatus in accordance with the present invention.
Figure 2:
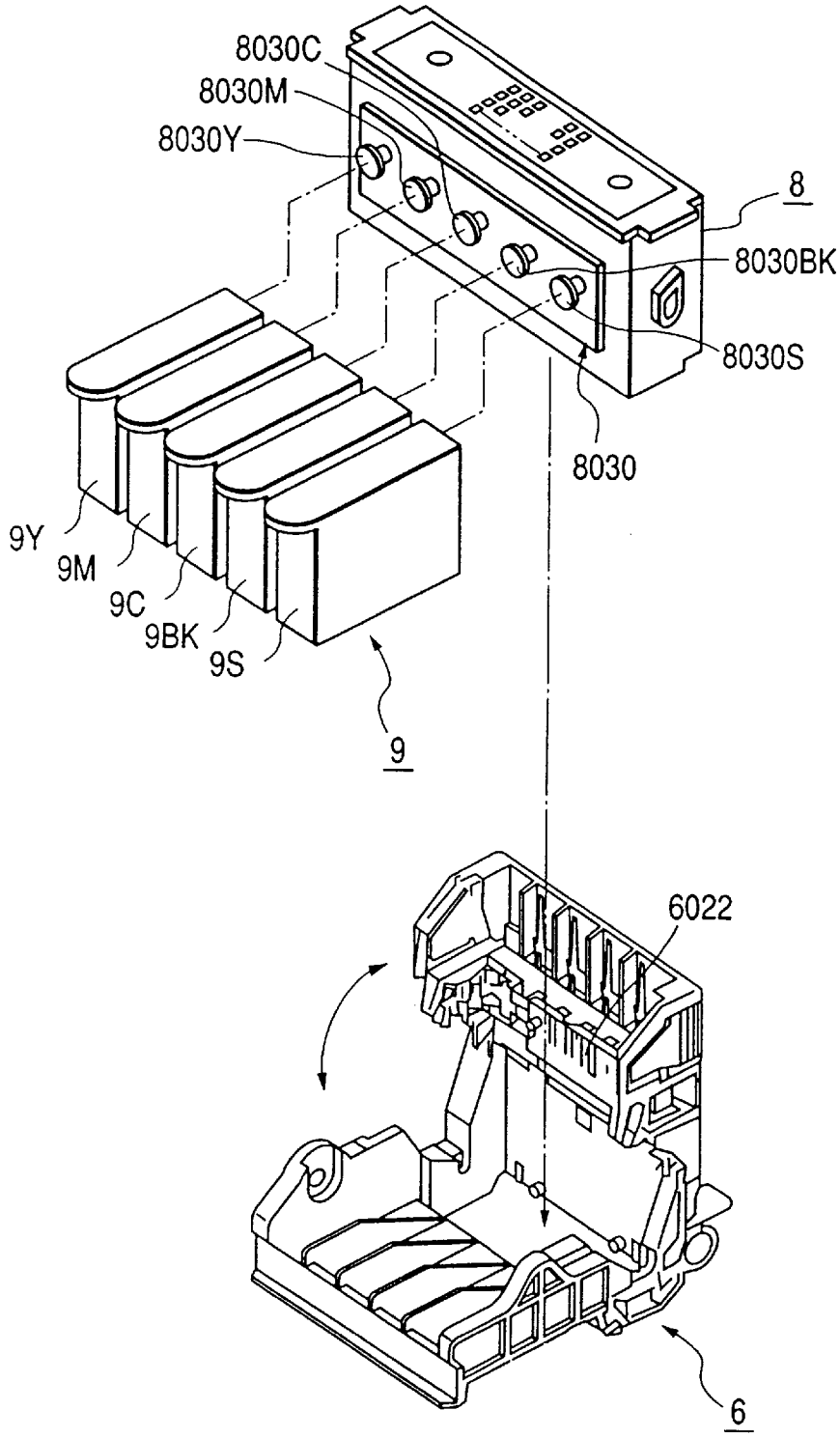
FIG. 2 is an exploded perspective view which shows the structure of the carriage and the recording head and ink tank mountable on the carriage of an ink jet recording apparatus in accordance with the present invention.

In FIG. 1, a reference numeral 6 designates a carriage. On the carriage, the recording head 8 for normal use is mounted, having the processing liquid S nozzle array, the black ink BK nozzle array, and the color ink YMC nozzle array, which are arranged side by side, as well as the ink tanks 9 (see FIG. 5A), such as the processing ink tank 9S and color ink tanks 9BK, 9C, 9M, and 9Y, from the portion nearer to the printing region at the home position as shown in FIG. 2. Each of the nozzle arrays of the color ink for yellow, magenta, and cyan is arranged side by side almost on the straight line.

Figure 5A:
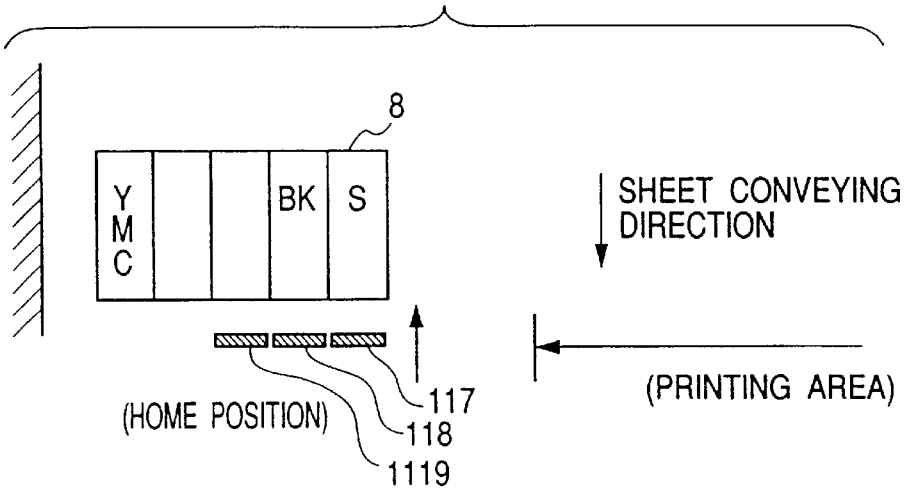
FIGS. 5A, 5B and 5C are views which illustrate the wiping operation in accordance with a first embodiment of the present invention.
Figure 5B:
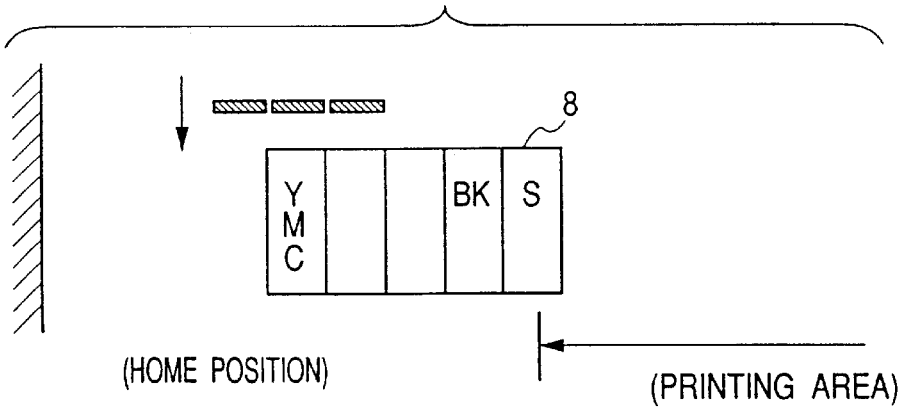
Figure 5C:
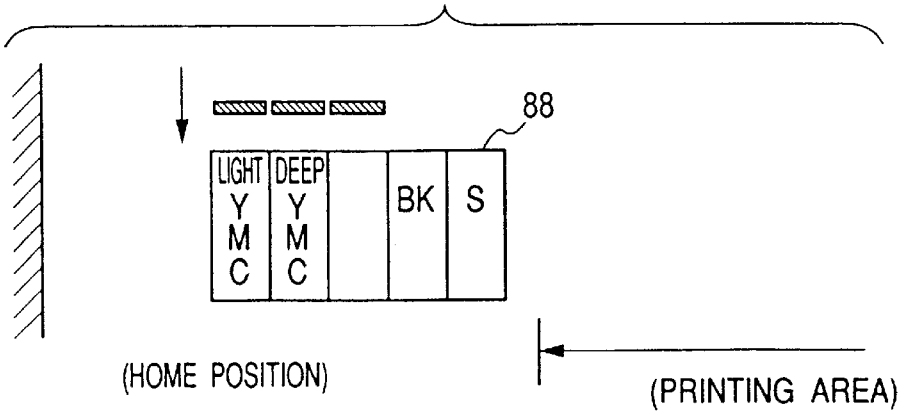

Also, in FIG. 5C, a reference numeral 88 designates an optional recording head exchangeably mountable for use of the formation of images in higher quality, in which a processing liquid nozzle array, a black ink BK nozzle array, a light color ink YMC nozzle array and a deep color ink YMC nozzle array are arranged side by side.

The recording head 8 is electrically connected through a connector 6022 on the carriage 6.

The recording head 8 is ink jet recording means that utilizes thermal energy for discharging ink, and provided with electrothermal transducing devices that generate thermal energy. Also, the recording head 8 utilizes changes of pressure exerted by the development and contraction of air bubbles formed by film boiling brought about by the application of thermal energy generated by the electrothermal transducing devices, hence discharging ink from the discharge openings for recording.

Figure 8:
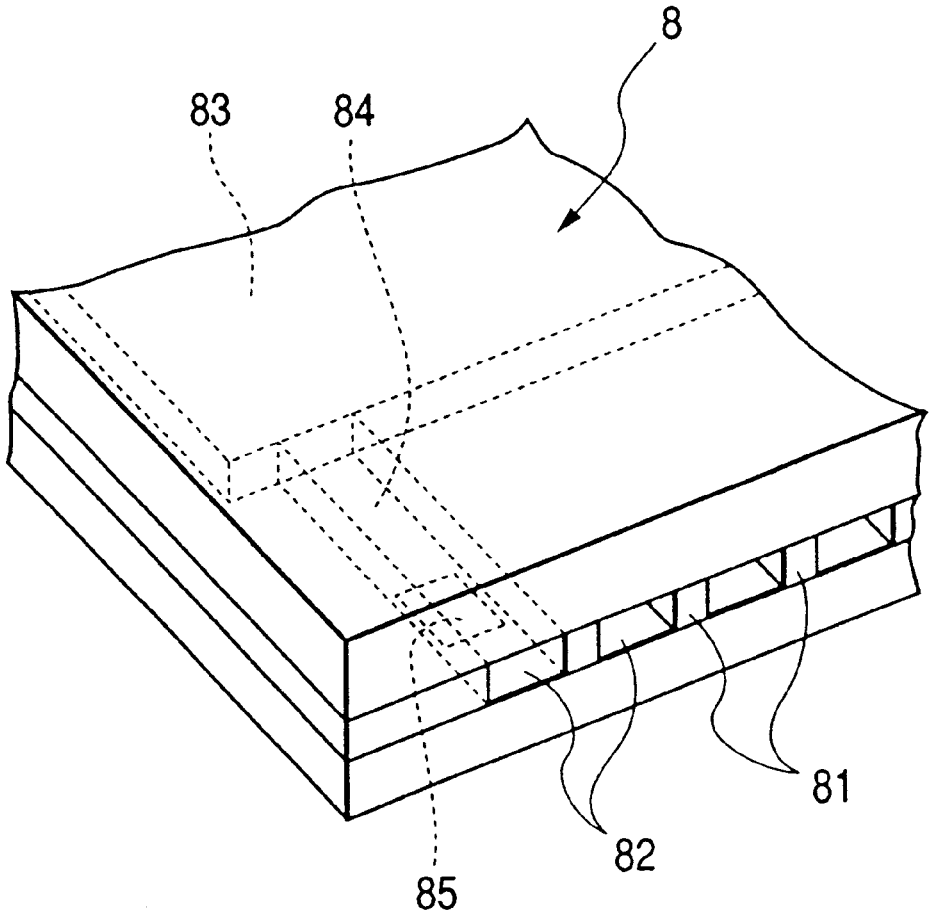
FIG. 8 is a partially perspective view which shows the structure of the ink discharge unit of a recording head.

FIG. 8 is a partially perspective view which schematically shows the structure of the ink jet unit of the recording head 8. In FIG. 8, a plurality of discharge openings 82 are arranged at specific pitches to form a nozzle array on the discharge opening formation surface 81 that faces a recording medium with a specific gap (approximately 0.5 to 2.0 mm, for example), and also, electrothermal transducing devices (heat generating resistors or the like) 85 are arranged along the wall surface of each of the liquid paths 84 conductively connected with a common liquid chamber 83 and each of the discharge openings 82.

The recording head 8 is mounted on the carriage 6 with such a positional relationship that the discharge openings 82 are arranged in a direction intersecting the scanning (traveling) direction of the carriage 6. In this state, the corresponding electrothermal transducing devices are driven (energized) in accordance with image signals or discharge signals to create film boiling in ink in each of the liquid paths 84. The recording head 8 is structured to discharge ink from the discharge openings 82 by the application of the pressure thus exerted at that time.

Also, for the recording head 8, ink supply openings 8030 are arranged (for use of processing liquid 8030S, black 8030BK, cyan 8030C, magenta 8030M, and yellow 8030Y) for supplying ink from the processing liquid ink tank 9S, color ink tanks 9BK, 9C, 9M, and 9Y respectively, and then, from the ink supply openings, ink is carried to each of nozzles of the recording head through the flow paths in the head accordingly.

As shown in FIG. 1, on both side walls of almost U-shaped chassis 1, a guide shaft 4 and a supporting shaft 103 are arranged to slidably support the carriage 6. The carriage 6 is driven by means of a carriage motor 104 through a driving belt 10 to reciprocate on these shafts in the scanning direction.

Also, a platen roller 2 and a pinch roller 3 are arranged to pinch and carry a recording medium (not shown) such as a paper sheet. The recording medium is carried on a platen 16. At this juncture, the recording head unit (not shown) of the recording head mounted on the carriage 6 extrudes downward from the carriage 6, while the discharge opening formation surface of the recording head unit faces the recording medium on the platen 16 in parallel to it. Here, the main body 40 to which the chassis 1 is fixed is provided with a waste ink tank 401.

Figure 3:
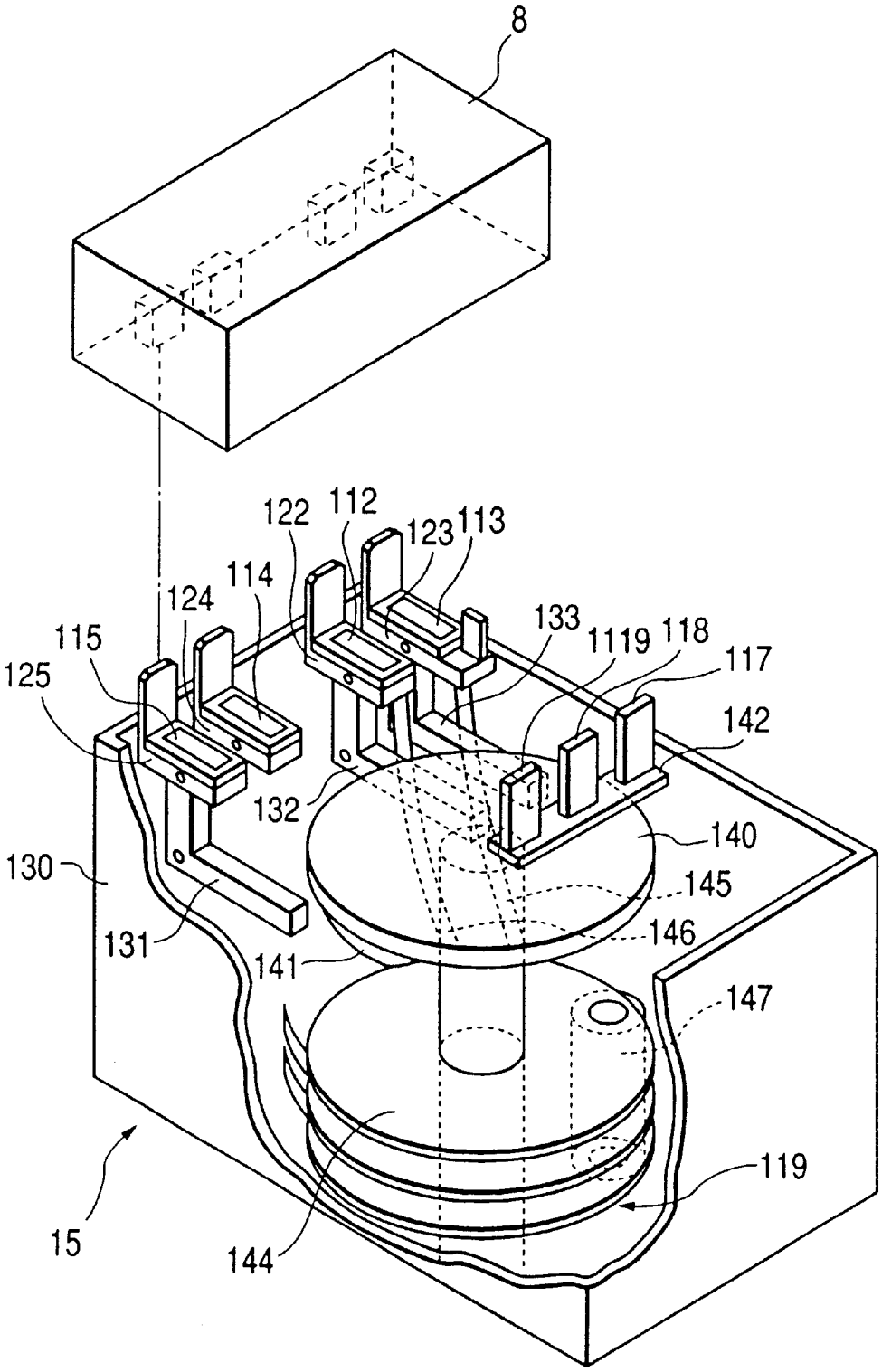
FIG. 3 is an exploded perspective view which shows the structure of the recovery system unit of an ink jet recording apparatus in accordance with the present invention.

A recovery system unit 15 is arranged on the home position side, which is on the left-hand side of the ink jet recording apparatus in accordance with the present embodiment. FIG. 3 is a perspective view which shows the recovery system unit. Facing the recording head 8, a processing liquid cap 113, a black ink cap 12, and color ink caps 114 and 115 are arranged from the right to the left in FIG. 3.

In this respect, the processing liquid cap 113 and the black ink cap 112 serve dually as suction cap and untouched cap. The color ink caps 114 and 115 are dedicated to serving only as untouched caps, and then, the structure is made to suck color ink by use of the black ink cap 112.

The caps 112 to 115 are fixed to the cap levers 131 to 133, which are rotatively and axially fixed to the recovery system base 130 through the cap holder 122 to 125, respectively. In this respect, the cap lever 131 serves dually to control cap holders 125, 125. The cap levers 131 to 133 are biased by cap springs. When a part of each of the levers slides on the cam surface 141 of the suction cam 140, each of them rotates in the vertical direction. Here, the structure is arranged so that each of the caps 112 to 115 is made vertically movable along this rotation.

The processing liquid cap 113 and the black ink cap 112 of the recovery system unit 15 are conductively connected with the tubes 145 and 146 of the pump unit 119 through the cap holder 123 and 122, respectively. The pump unit 119 is used for exerting negative pressure when the recording head presents defective discharges, which requires suction recovery or the like that sucks ink from the recording head while connecting the cap unit and the recording head. The pump unit 119 exemplified here is called a tube pump.

The pump unit 119 comprises tubes 145 and 146; a roller holder 144, and a roller 147. The roller holder 144 is rotatively and axially fixed to the recovery system base 130. The tubes 145 and 146 are squeezed while the roller 147, which is axially fixed to the roller holder 144, pushes down the tubes 145 and 146 guided by the roller holder 144, thus exerting negative pressure in the cap. The pump unit 119 is provided with the tube 145 which is dedicated to use of processing liquid, and the tube 146 for use of ink individually. Waste ink is carried to the waste ink tank by way of each individual path. This arrangement is needed for the prevention of insolubilization in the cap and pump, which may be caused if recording color ink and processing liquid are in contact with each other. Here, two systems of pump unit are shown for use of processing liquid and recording color ink. However, pump units may be provided for each of the caps individually.

The recovery system unit 15 is further provided with the processing liquid blade 117 that perform wiping for the discharge opening unit of the processing liquid recording head, and the color ink blade 118 that performs wiping for the discharge opening unit of the color ink recording head.

The processing liquid blade (first blade) 117 is arranged on the downstream side of the processing liquid nozzle array in the sheet conveying direction. The color ink blade (second blade) 118 is arranged on the downstream side of the black ink nozzle array in the sheet conveying direction. These blades are arranged each individually. Here, the color ink blade 118 moves in the arrangement direction of nozzle array, and as shown in FIGS. 5A, 5B and 5C, wiping is performed for the black and color nozzle arrays of the recording head for the normal use, and also, for the deep ink nozzle array of the recording head 88 for the optional use. A reference numeral 1119 designates the blade (third blade) that performs wiping for the light ink nozzle array of the recording head 88 for the optional use, which is arranged on the left side of the color ink blade 118 with a shift which is equivalent to the pitch portion of the nozzle array.

Each of these blades is formed by rubber or some other elastic material in order to wipe color ink or processing liquid adhering to each of the discharge opening formation surfaces of the recording heads.

Figure 4:
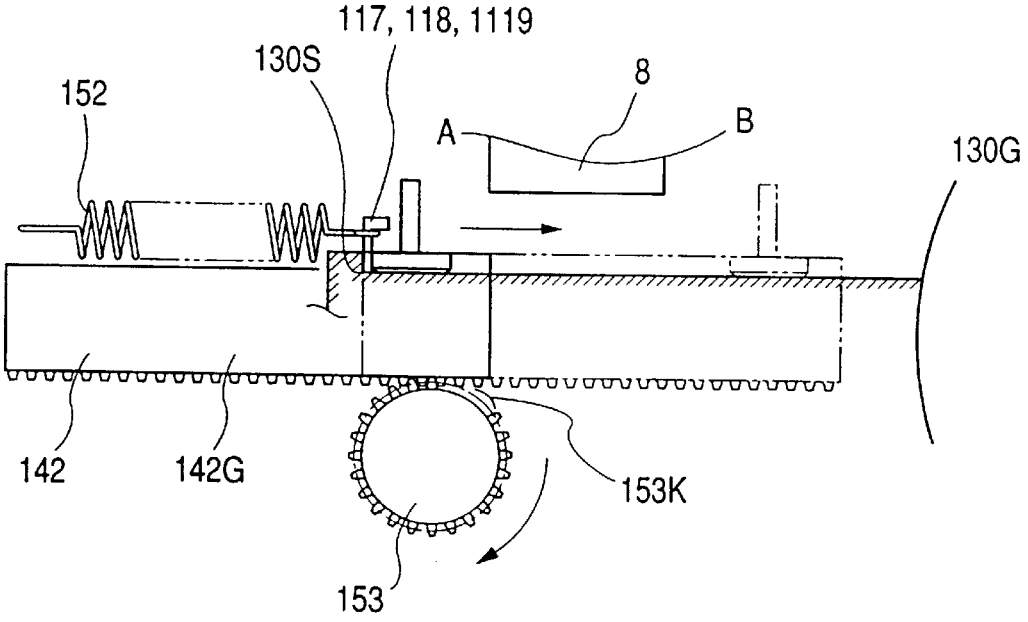
FIG. 4 is a cross-sectional view which shows the structure of the wiping mechanism of an ink jet recording apparatus in accordance with the present invention.

As shown in FIG. 4, the blades 117, 118, and 1119 are fixed to the blade arm 142 installed movably on the guide unit 130G of the recovery system base 130 in parallel to the recording head 8. Also, the guide unit 130G is arranged to control and manage the advancing amount of blade and its contact angle and pressure to keep them in normal condition constantly.

On a part of the blade arm 142, the rack gear 142G is arranged to engage with the driving gear 153 in a state of being biased by means of a wiper spring 152. Each of the blades 117, 118, and 1119 is not allowed to be in contact with the recording head 8 when being biased by the wiper spring 152 (first retracted position A). Here, a reference numeral 130S designates a device arranged for the recovery system base 130 to regulate the retracted position of the blade arm.

When the driving gear 153 is driven by means of a driving source to rotate, the blade arm 142 moves on the recovery system base 130 in parallel to the recording head 8 (forward). When the blades 117, 118, and 1119 move further from the position (second retracted position) where the blades do not abut upon the recording head after the blade arm 1423 has moved by the sufficient stroke of the nozzle array, the gear tooth of the driving gear 153 is partly cut off at 153K. Therefore, the transmission of driving power is suspended, thus enabling the blade arm to return to the first retracted position by means of the spring force of the wiper spring 152 (backward).

In each of the blade arm retracted positions, the recording head 8 moves to an arbitrary position for the selection of the blades 117, 118, and 1119. Then, reciprocal wiping becomes possible in the arbitrary direction.

FIGS. 5A, 5B and 5C are views which illustrate the wiping operation in accordance with the present embodiment.

FIG. 5A shows the initial position for wiping the nozzle array of the processing liquid S and the nozzle array of the black ink BK for the recording head 8 for normal use. FIG. 5B shows the initial position for wiping the nozzle array of the color ink YMC. FIG. 5C shows the initial position for wiping the nozzle array of the deep and light ink of the recording head 88 for the optional use.

In case of the recording head 8 for the normal use as shown in FIG. 5A, the blade is caused to move from the first retracted position to perform wiping in the forward direction for the processing liquid S nozzle array and the black ink BK nozzle array. Also, as shown in FIG. 5B, the recording head 8 is caused to move to the initial position for wiping the color ink YMC nozzle array, and the blade moves from the second retracted position to perform wiping in the backward direction for the color ink YMC nozzle array.

For the recording head 88 for the optional use, the blade is caused to move from the first retracted position, and as in the case shown in FIG. 5A, wiping is performed in the forward direction for the processing liquid S nozzle array and the black ink nozzle array. Also, as shown in FIG. 5C, the recording head 88 is caused to move from the second retracted position to the initial position for wiping the deep and light ink YMC nozzle arrays. The blade moves from the second retracted position to perform wiping in the backward direction for the deep and light ink YMC nozzle arrays, respectively.

(Embodiment 2)

Figure 6A:
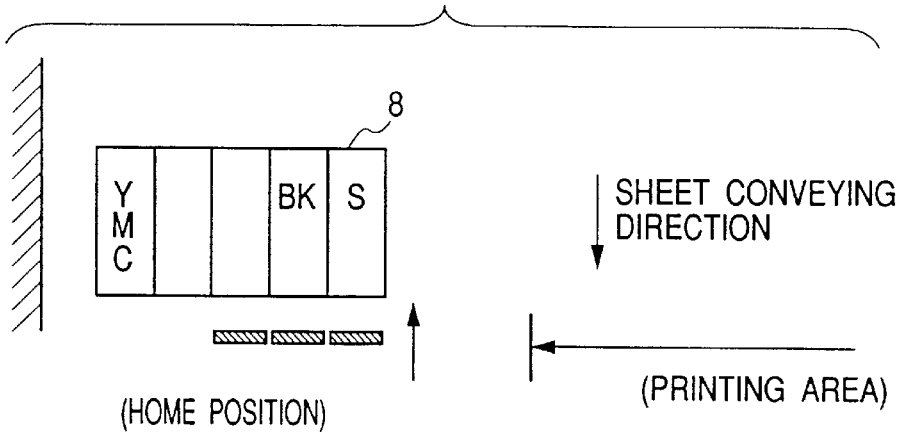
FIGS. 6A, 6B and 6C are views which illustrate the wiping operation in accordance with a second embodiment of the present invention.
Figure 6B:
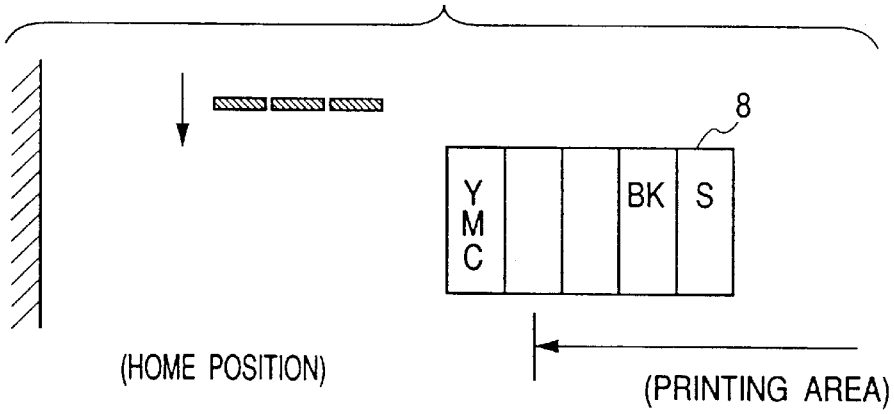
Figure 6C:
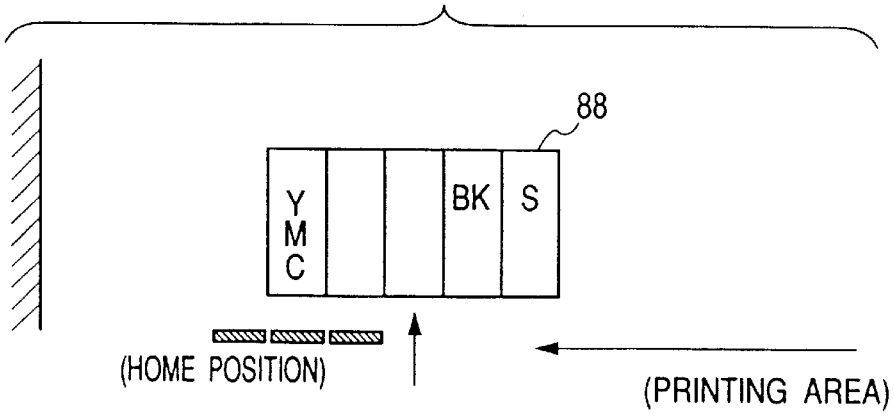

FIGS. 6A, 6B and 6C are views which illustrate the wiping operation for an ink jet recording apparatus in accordance with another embodiment of the present invention. The mechanism of the ink jet recording apparatus of the present embodiment is the same as that of the first embodiment described in conjunction with FIGS. 1, 2, 3 and 4. Therefore, the description thereof will be omitted.

FIG. 6A shows the initial position for wiping the processing liquid nozzle array and the black ink BK nozzle array for the recording head 8 for the normal use. FIG. 6B shows the state that the recording head 8 is retracted to the position where no blade abuts upon the recording head 8. The blade is caused to return from the second retracted position in the backward direction. FIG. 6C shows the initial position for wiping the color ink YMC nozzle array.

In accordance with the first embodiment, the wiping direction is changed depending on the nozzle arrays. The present embodiment is characterized in that the wiping directions of all the nozzle arrays are limited to one direction.

In other words, if the wiping direction for nozzle arrays should be defined only to the forward direction, the recording head 8 is retracted to the position where no blade abuts upon the recording head 8, and then, the blade should be returned from the second retracted position in the backward direction after wiping.

Also, if the wiping direction for nozzle arrays should be defined only to the backward direction, the recording head 8 is retracted to the position where no blade abuts upon the recording head 8, and then, the blade should be returned to the second retracted position, while the recording head 8 is caused to move to an arbitrary position. After that the wiping is performed.

(Embodiment 3)

Figure 7A:
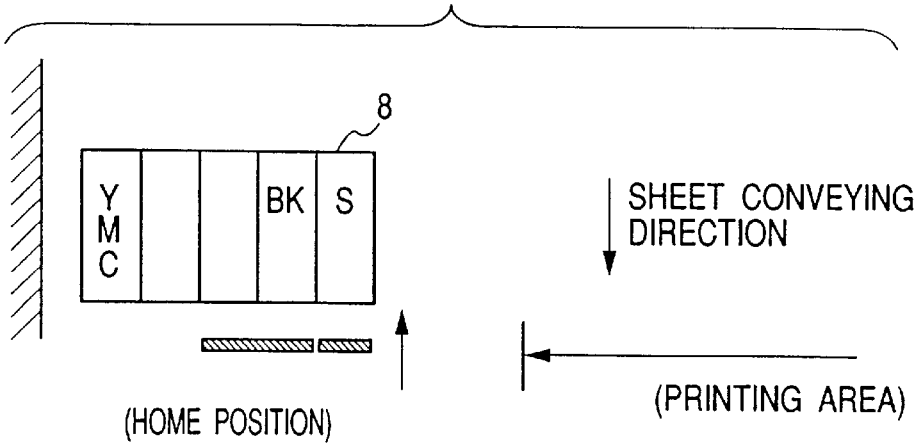
FIGS. 7A, 7B and 7C are views which illustrate the wiping operation in accordance with a fourth embodiment of the present invention.
Figure 7B:
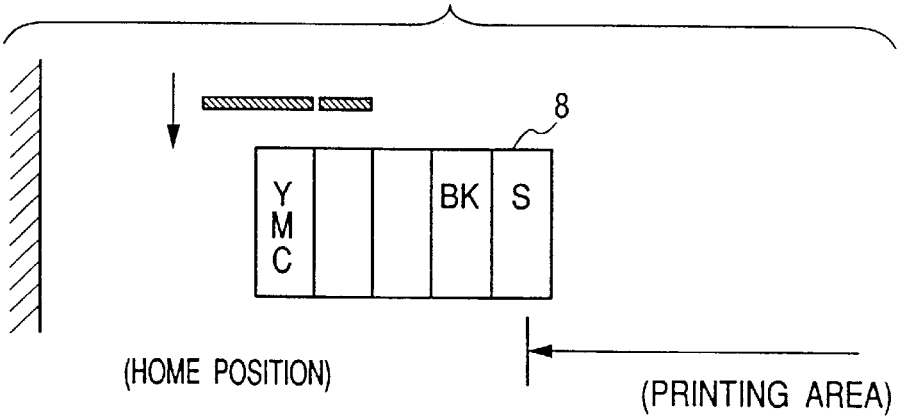
Figure 7C:
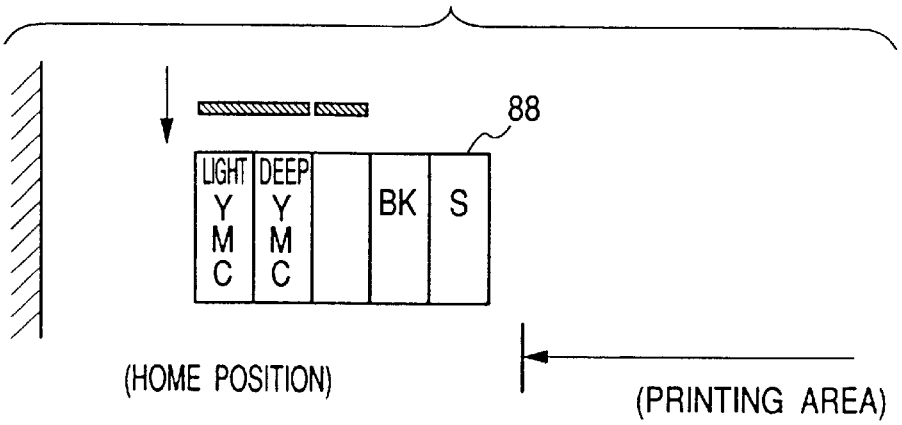

FIGS. 7A, 7B and 7C are views which illustrate the wiping operation in accordance with still another embodiment of the present invention. The mechanism of the ink jet recording apparatus of the present embodiment is the same as that of the first embodiment described in conjunction with FIGS. 1, 2, 3 and 4. Therefore, the description thereof will be omitted.

FIG. 7A shows the initial position for wiping the processing liquid nozzle array and the black ink BK nozzle array of the recording head 8 for the normal use. FIG. 7B shows the initial position for wiping the color ink YMC nozzle array. FIG. 7C shows the initial position for wiping the deep and light ink nozzle arrays for the recording head 88 for the optional use.

The present embodiment is characterized in that the blade structure of the first embodiment is modified, that is, the second blade and the third blade are formed integrally for the reduction of the blade numbers in order to attempt the reduction of costs accordingly.

What is claimed is:

1. An ink jet recording apparatus comprising:

a carriage having a first liquid discharge unit provided with first liquid discharge openings for discharging a first liquid and a second liquid discharge unit provided with second liquid discharge openings for discharging a second liquid different from the first liquid, said first liquid discharge unit and said second liquid discharge unit being arranged for performing discharge when the carriage is moving;

a first wiping member dedicated to wiping a surface of the first liquid discharge unit having said first liquid discharge openings, said first wiping member being arranged for wiping when the movement of said carriage is suspended; and a second wiping member dedicated to wiping a surface of the second liquid discharge unit having said second liquid discharge openings, said second wiping member being arranged for wiping when the movement of said carriage is suspended, wherein said carriage is stopped at a first stopping position so that wiping by said first wiping member is performed by a movement of said first wiping member along a direction different from a movement direction of said carriage, and said carriage is stopped at a second stopping position different from said first stopping position so that wiping by said second wiping member is performed by a movement of said second wiping member along a direction different from the movement direction of said carriage.

2. An ink jet recording apparatus according to claim 1, wherein the second liquid is a liquid which insolubilizes a coloring material in the first liquid, thereby reducing the solubility of the coloring material by a solvent.

3. An ink jet recording apparatus according to claim 1, wherein said first liquid discharge openings of said first liquid discharge unit include a discharge opening array for discharging black recording liquid, and a plurality of separate discharge opening arrays for discharging each of yellow, magenta and cyan recording liquids, respectively, to form a recording head together with said second liquid discharge unit.

4. An ink jet recording apparatus according to claim 3, wherein a locus of a leading end of each of said first and second wiping members is substantially parallel to a direction of said discharge opening arrays at the time of a wiping operation.

5. An ink jet recording apparatus according to claim 3, wherein a wiping direction of each of said first and second wiping members is determined according to the discharge openings that are being wiped.

6. An ink jet recording apparatus according to claim 1, wherein said first liquid discharge openings of said first liquid discharge unit include a discharge opening array for discharging black recording liquid, a plurality of separate discharge opening arrays for discharging each of yellow, magenta and cyan recording liquids, respectively, and a plurality of separate discharge opening arrays for discharging recording liquids of a deeper yellow than said yellow recording liquid, a deeper magenta than said magenta recording liquid, and a deeper cyan than said cyan recording liquid, respectively, to form a recording head together with said second liquid discharge unit.

7. An ink jet recording apparatus according to claim 6, wherein a locus of a leading end of each of said first and second wiping members is substantially parallel to a direction of said discharge opening arrays at the time of a wiping operation.

8. An ink jet recording apparatus according to claim 6, wherein a wiping direction of each of said first and second wiping members is determined according to the discharge openings that are being wiped.

9. An ink jet recording apparatus according to claim 1, wherein each of said first and second wiping members is capable of obtaining a first retracted position and a second retracted position in which said wiping member is not in contact with said first liquid discharge unit or with said second liquid discharge unit.

10. An ink jet recording apparatus according to claim 1, wherein said apparatus is provided with electrothermal transducing devices for generating thermal energy to be utilized for discharging each of said first liquid and said second liquid.

11. An ink jet recording apparatus according to claim 10, wherein said first liquid and said second liquid are discharged from each of said first liquid discharge openings and said second liquid discharge openings, respectively, by utilization of film boiling created in each said liquid by thermal energy generated by said electrothermal transducing devices.

* * * * *

UNITED STATES PATENT AND TRADEMARK OFFICE

CERTIFICATE OF CORRECTION

PATENT NO. : 6,499,824 B1
DATED : December 31, 2002
INVENTOR(S) : Nitta

It is certified that error appears in the above-identified patent and that said Letters Patent is hereby corrected as shown below:

Column 1,
Line 34, “enables operates” should read -- enables to operate --.

Column 3,
Line 12, “are,” should read -- are --.

Column 6,
Line 59, “125, 125.” should read -- 124, 125. --

Signed and Sealed this

Fourteenth Day of October, 2003

JAMES E. ROGAN
*Director of the United States Patent and Trademark Office*